United States Patent [19]

Martell et al.

[11] Patent Number: 4,526,114

[45] Date of Patent: Jul. 2, 1985

[54] METHOD AND APPARATUS FOR SEWING MITERED CORNERS ON A SPLIT NEEDLE BAR SEWING MACHINE

[75] Inventors: Charles R. Martell; Elmer N. Leslie, both of Dallas; Stephen S. Treadwell, Richardson, all of Tex.

[73] Assignee: Microdynamics, Inc., Dallas, Tex.

[21] Appl. No.: 469,779

[22] Filed: Feb. 25, 1983

[51] Int. Cl.[3] ..... D05B 19/00; D05B 27/22; D05B 1/08

[52] U.S. Cl. ..... 112/262.1; 112/121.11; 112/275; 112/315

[58] Field of Search ..... 112/121.11, 121.12, 112/272, 275, 2, 315, 262.1, 163, 314

[56] References Cited

U.S. PATENT DOCUMENTS

| | | | |
|---|---|---|---|
| 3,459,145 | 8/1969 | Ramsey et al. . | |
| 3,804,040 | 4/1974 | Arnold . | |
| 4,069,778 | 1/1978 | Kozawa . | |
| 4,130,073 | 12/1978 | Kimura et al. . | |
| 4,178,862 | 12/1979 | Bianchi et al. | 112/163 X |
| 4,359,953 | 11/1982 | Martell et al. . | |
| 4,403,558 | 9/1983 | Martell et al. | 112/275 X |
| 4,404,919 | 9/1983 | Martell et al. | 112/315 X |
| 4,445,449 | 5/1984 | Kuzuya et al. | 112/121.11 |

*Primary Examiner*—Peter Nerbun

*Attorney, Agent, or Firm*—Jerry W. Mills; Gregory W. Howison

[57] ABSTRACT

A semi-automatic split needle bar sewing machine (10) includes a sewing machine (12) which is driven by a motor (26) that drives a left needle (22) and a right needle (23). A presser foot (24) is operated by presser lift actuator (30). The needles (22) and (23) can activate in unison or independently by use of fall out actuators (41) and (43), respectively. A control chassis (50) includes a microprocessor controller (51) that is programmable through an input panel (44). An edge detector (40) detects the edge of the material to provide feedback for the microprocessor controller (51). The microprocessor controller (51) is operable to sew a decorative pattern with mitered corners by sensing the pivot point of the mitered corner and automatically disengaging one of the needles (22) or (23). The microprocessor controller (51) then continues single needle sewing around the apex of the mitered corner by counting a predetermined number of stitches and varying the length of the stitches such that the needle is in the correct position when the single needle sewing again arrives at the pivot point on the other side of the mitered corner. In this manner, it is not necessary for the operator to manually adjust the length of the stitches around the apex of the mitered corner.

30 Claims, 12 Drawing Figures

FIG. 1
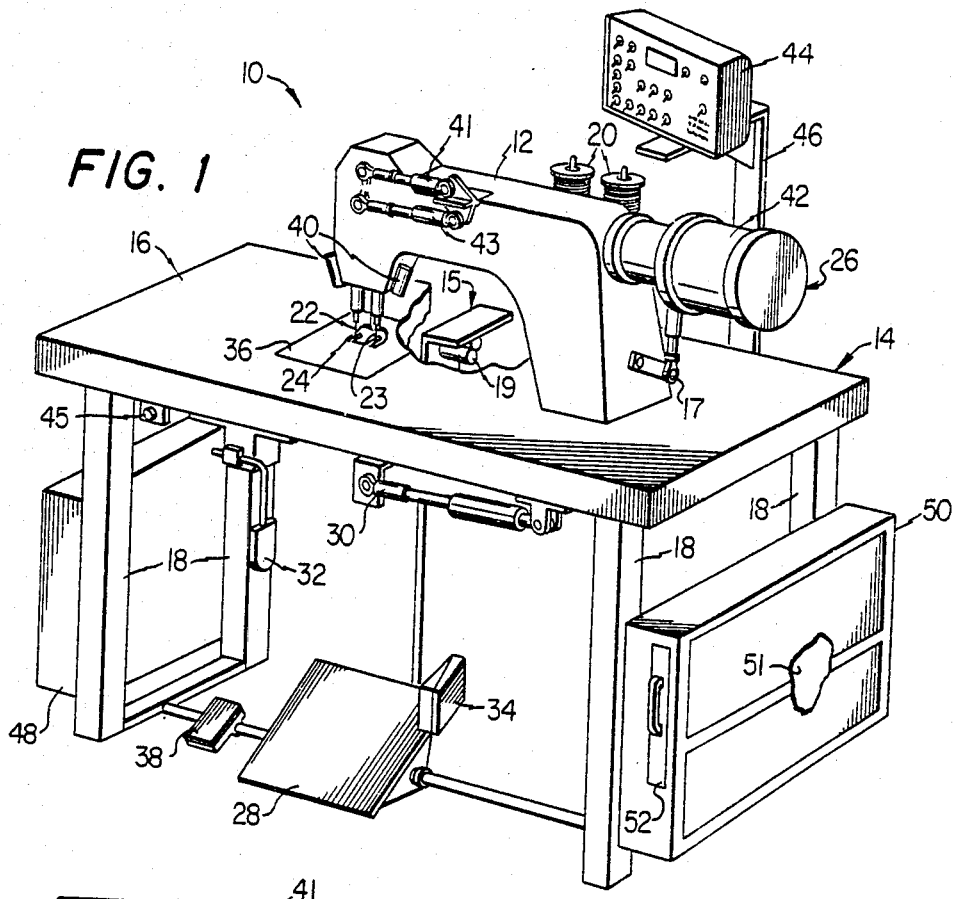
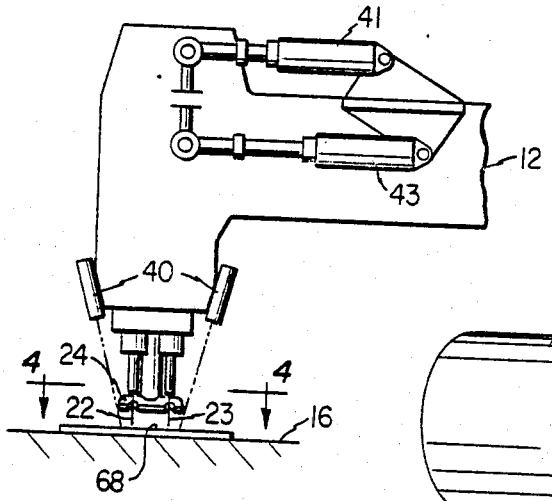
FIG. 3
FIG. 2
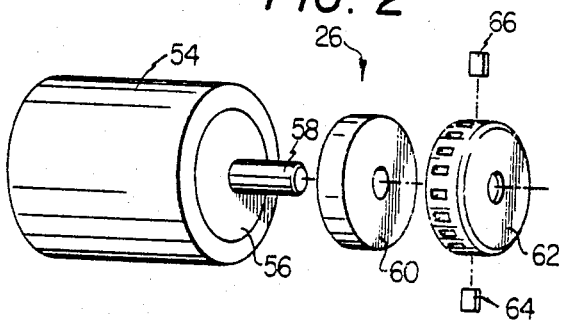

METHOD AND APPARATUS FOR SEWING MITERED CORNERS ON A SPLIT NEEDLE BAR SEWING MACHINE

TECHNICAL FIELD

The present invention pertains in general to the sewing of mitered corners and, more particularly, to automatic sewing of mitered corners on a split needle bar sewing machine.

BACKGROUND OF THE INVENTION

Double needle, decorative and functional stitching is often desirable to use for such apparel items as shirt pockets and pocket flaps. The flaps normally utilize the two needle stitching as purely decorative since the stitching does not serve a primarily functional purpose, whereas two needle stitching on pockets is both decorative and functional. When two needle decorative stitching is required, a special type of sewing machine is employed to produce the desired "mitered corner" decorative effect at pivot points. This machine type employs two needles to simultaneously sew parallel seams. The machines, which are referred to as "split needle bar" machines, differ from ordinary double needle machines in that the left or right needle can be selectively disabled in order to produce the mitered corner effect at pivot points. The distance between the needles is referred to as the needle gauge and the machines are normally available with gauges of 1/16th inch to ½ inch in 1/16th inch increments.

Although split needle bar machines produce a very pleasing decorative effect, operation of the machine requires considerable skill and time to selectively disengage and re-engage the appropriate needle at each pivot point. If desired, a two needle decorative stitching pattern can be achieved by using a conventional single needle machine. When a single needle machine is employed, the operator is required to stitch the decorative pattern two times utilizing a different seam margin each time. This technique is very time consuming since the operation must be sewn twice and the machine must be adjusted to provide a different seam margin for the second seam. In addition, the stitches in the two seams are not "synchronized" such that the individual stitches in the double needle mode may not be "in step" with each other. This lack of synchronization degrades the appearance of the two needle decorative stitching.

Conventional double needle machines cannot be used to perform the two needle decorative stitching operation because the inside needle must not sew as many stitches as the outside needle if the correct mitered corner is to be obtained at a pivot point. This is due to the fact that the additional stitches sewn generate what is referred to in the apparel industry as the "crow's foot" which is not acceptable on quality garments.

Split needle bar machines which have the ability to selectively disable the left or right needle have been developed to solve the two needle decorative stitching problem. These machines are available from a wide variety of sewing machine manufacturers and include among others the Brother Model 835, Durkopp Model 380, Juki Model 528, Consew Model 328 or Pfaff Models 542 or 1242. These machines have mechanical linkages which can be manually operated by the operator to disengage the desired needle. Since most two needle decorative stitching is performed as a top stitching or setting operation, the operator must precisely control the distance from the outside edge of the material to the outside needle. This distance is referred to as the "seam margin". In order to sew a 90° mitered corner correctly, the operator sews along the first segment until a point is reached that is equal to the sum of the distance between the two needles and the seam margin which is defined as the pivot point of the mitered corner. At that point, referred to hereinafter as the "pivot point", additional stitches would be sewn using the right needle until the outside corner of the mitered corner was reached, referred to hereinafter as the "apex" of the mitered corner. At the apex, the presser foot would then be lifted and the material pivoted in a counterclockwise direction in preparation for sewing the second seam, for example, 90° for a right angled mitered corner. The presser foot would then be lowered and additional stitches would be sewn with the right needle until the needle is again lined up with the pivot point. The left needle is then re-engaged at the pivot point and sewing would resume to sew the second seam.

In practice, the operator normally has to shorten or lengthen the last stitch in the double needle mode in order to achieve the correct pivot point. This may also be the case with the stitches sewn from the pivot point to the apex. For example, if the angle to be turned is 90° and if the needle gauge is ¼ inch, a stitch density of 8 stitches per inch (spi) will assure that two stitches with the right needle before and after the apex will provide the correct mitered corner. Although this works quite well with a 90° corner, a mitered corner in the same sewing operation may involve a cornering angle of 60°. This case represents a "complex" case in that the correct mitered corner cannot be obtained unless the length of one single needle stitch before the apex and one single needle stitch after the apex is varied from the standard stitch length (⅛th of an inch at 8 spi in this example). This is also the situation with cornering angles for 30°, 120° and 150°. A different number of complete and/or partial stitches is required to achieve the correct mitered corner in each of these cases.

In order to manually sew a mitered corner, the operator produces shorter (or longer) stitches by overriding the sewing machine's feeding machanism during the cornering sequence. The operator must calculate how many full and partial stitches are needed for each cornering angle in an empirical "trial and error" manner and thus repeat the required sequence consistently on subsequent parts. The distance from the edge at which the cornering sequence must be initiated varies according to the cornering angle. This requires the operator to make a number of decisions such as determining the distance from the edge for initiating the cornering sequence, adjusting the length of the last stitch sewn in the double needle mode, disengaging the appropriate needle, determining the accurate dimensions for the seam margin, adjusting the length of the last stitch, realigning the material, sewing the required number of stitches with the single needle and re-engaging the disabled needle to resume double needle sewing. These steps require a high level of operator skill to perform the cornering sequence correctly. In addition, a considerable amount of time is required to produce the correct mitered corner at a pivot point because of the manipulation of the sewing machine required to disengage the needle and sew the normal and partial stitches.

Sewing machine manufacturers have developed control mechanisms that simplify the operation of the "simple" cases. For example, the Juki Model ACl and the Brother Model 835-903 control units can be used to program a "simple" cornering sequence involving only normal length stitches. In addition, an apparatus for split bar needle sewing of mitered corners is illustrated in U.S. Pat. No. 4,359,953 issued to the present applicant. With these units, the operator must sew to the pivot point and disengage the appropriate needle. The control unit will then cause a programmed number of stitches to be sewn with the single needle and then stop with the needle down. The operator must then lift the presser foot, pivot and realign the material and then depress the foot treadle. The control unit will cause a programmed number of stitches to be sewn in the single needle mode and then will automatically re-engage the needle. These control units are helpful but they still require considerable operator skill and they cannot handle the "complex" cases.

In view of the above described disadvantages with the prior art, there exists a need for a sewing machine for sewing mitered corners which automatically controls the operation of the sewing machine. In so doing, a higher degree of repeatability and quality will be attained without having to maintain a high level of operator skill at the machine.

SUMMARY OF THE INVENTION

The present invention disclosed and claimed herein comprises a method and apparatus for sewing mitered corners on a split needle bar sewing machine for sewing mitered corners with decorative and functional stitching on apparel products. The apparatus includes a split needle bar that is capable of retracting one of the needles thereof to convert from double needle sewing to single needle sewing, a stitch counter and a variable stitch length mechanism to vary the length of the stitches. A microprocessor controller controls the stitching operation to automatically terminate double needle sewing at an operator specified pivot point of the mitered corner and resume single needle sewing around the apex thereof. The number of stitches and stitch length therearound is automatically varied to assure the correct mitered corner is produced. The microprocessor controller then resumes double needle sewing at the pivot point.

In another embodiment of the present invention, an edge detector is included that senses a discontinuity in the material from the feeding side of the sewing machine such that a reference is provided for the microprocessor controller. With this reference, the microprocessor controller can automatically determine the position of the pivot point at which to initiate the cornering sequence.

In yet another embodiment of the present invention, the stitch counter is used to enable the microprocessor controller to determine the number of stitches sewn from the initiating point of each seam to the pivot point.

In a further embodiment of the present invention, a method is provided that includes the steps of automatically terminating double needle sewing at the pivot point of the mitered corner and allowing only single needle sewing therefrom. The single needle sewing is automatically terminated after sewing a predetermined number of stitches to the apex, the number and length of the stitches automatically varied to obtain a mitered corner. The presser foot is then automatically raised and lowered to allow the material to be realigned and then the number and length of stitches between the apex and the pivot point during single needle sewing is controlled and at the pivot point, double needle sewing is automatically resumed.

BRIEF DESCRIPTION OF THE DRAWINGS

For a more complete understanding of the present invention and the advantages thereof, reference is now made to the following description taken in conjunction with the accompanying Drawings in which:

FIG. 1 illustrates a perspective view of the sewing machine of the present invention;

FIG. 2 illustrates an exploded view of the motor, the brake and the sensor assemblies;

FIG. 3 is a frontal view illustrating placement of the edge sensors relative to the sewing needles;

DETAILED DESCRIPTION OF THE INVENTION

Figure 4:
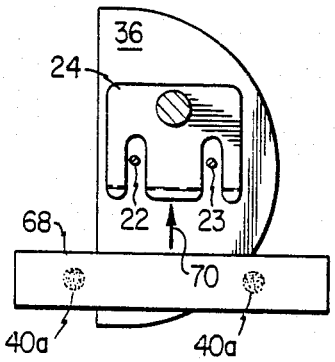
FIG. 4 is a sectional view taken along lines 4—4 of FIG. 3.

Referring now to FIG. 1, there is illustrated a perspective view of a semi-automatic split bar needle sewing system 10 incorporating the invention. System 10 is a microprocessor-based system which extends the capabilities of a sewing machine by enabling the operator to perform sewing procedures on a manual or semiautomatic basis, as will be more fully explained hereinafter.

System 10 includes a conventional split needle bar sewing machine 12 mounted on a work stand 14 consisting of a table top 16 supported by four legs 18. Sewing machine 12, which is of conventional construction, includes a spool 20 containing a supply of thread for stitching by a left needle 22 and a right needle 23 to form a double seam in one or more pieces of material. Surrounding the needles is a vertically movable presser foot 24 for cooperation with a feed dog (not shown). The feed dog is positioned on the table top 16 for feeding both a lower layer of material and an upper layer of material past the needles 22 and 23. A feed drop out mechanism (not shown) is also provided that drops out the feed mechanism for driving the feed dog. This mechanism facilitates the sewing of shorter stitches than the present stitch density. The feed drop out mechanism is a readily available feature of machines such as the Pfaff models 487 and 483.

A number of standard controls are associated with the sewing machine 12 for use by the operator in controlling its function. A handwheel 26 is attached to the drive shaft (not shown) of the machine 12 for manually positioning the needles 22 and 23 in the desired vertical position. The sewing speed is controlled by a speed sensor 15 that is actuated by a foot pedal 28, which functions like an accelerator. Vertical positioning of the presser foot 24 can be controlled by heel pressure on the foot pedal 28 which closes a switch 19 in the speed sensor 15, which in turn causes a presser foot lift actuator 30, corresponding to the presser foot 24, to operate. A leg switch 32 is provided for controlling the sewing direction of the machine 12 by causing operation of a reverse sew lever actuator 17. A toe switch 34 located adjacent to the foot pedal 28 controls a conventional thread trimmer (not shown) disposed underneath a toe plate 36 on machine 12. A foot switch 38 on the other side of the foot pedal 28 comprises a one-stitch switch commanding the machine 12 to sew a single stitch.

The left needle 22 and the right needle 23 operate synchronously to sew a double stitch and individually by use of a conventional throw-out mechanism (not shown) connected to the needles. Suitable double needle sewing machines, such as the Pfaff 542 or the Juki 528, are commercially available. A pair of actuators 41 and 43 are connected to the throw-out mechanisms of needles 22 and 23, respectively. A command switch 45 is connected to the needle throw-out actuators 41 and 43 for manual operation thereof. As will be described hereinbelow, the needles 22 and 23 can be disabled automatically.

It will thus be understood that sewing machine 12 and its associated manual controls are of substantially conventional construction, and may be obtained from several commercial sources. For example, suitable sewing machines are available from Singer, Union Special, Pfaff, Consew, Juki, Columbia, Brother and Durkopp Companies.

In addition to the basic sewing machine 12 and its manual controls, the system 10 also includes several components for adapting the sewing machine for semi-automatic operation. A pair of sensors 40 are mounted in laterally spaced apart relationship in front of the needles 22 and 23 and presser foot 24. A drive unit 42 comprising a variable speed direct drive motor is attached to the drive shaft of the sewing machine 12. A main control panel 44 supported on a bracket 46 is provided above one corner of the work stand 14. The control panel 44 has various switches disposed on the surface thereof. From one side of the work stand 14 there is a pneumatic control chassis 48 containing an air regulator, filter and lubricator for the sewing machine control devices, pneumatic actuators and other elements of the system 10. All these components are of known construction and are similar to those shown in U.S. Pat. Nos. 4,108,090; 4,104,976; 4,100,865, 4,092,937 and 4,359,953, the disclosures of which are incorporated herein by reference.

A controller chassis 50 is located on the opposite side of the work stand 14 for housing the electronic components of the system 10. Chassis 50 includes a microprocessor controller 51, appropriate circuitry for receiving signals from sensors and carrying control signals to actuators, and a power module for providing electrical power at the proper voltage level to the various elements of system 10. The microprocessor controller 51 may comprise a Zilog model Z-80 microprocessor or any suitable unit having a read only memory (ROM) and a random access memory (RAM) of adequate storage capacities. The controller 51 is programmed in accordance with the present invention to provide a predetermined profile for the sewing operation. An auxiliary panel 52 is mounted for sliding movement on one end of the chassis 50.

Referring now to FIG. 2, there is illustrated an exploded perspective view of the drive unit 42 of FIG. 1 and the system 10. The drive unit 42 includes a housing 54 enclosing a variable speed drive motor 56 having a drive shaft 58 coupled directly to the drive shaft of the sewing machine 12. An electromagnetic brake 60 is secured to the shaft 58 as are a sensor vane 62 and the handwheel 26; of which the handwheel has been omitted from FIG. 2 for clarity. The sensor vane 62 includes a plurality of uniformly spaced openings therearound which cooperate with sensor 64 and 66 to provide an indication to the microprocessor controller 51 of the angle in the sewing cycle at which the shaft 58 is positioned. In addition, the sensors 64 and 66 also provide an indication to the microprocessor controller 51 of the number of revolutions that the motor has progressed through which directly corresponds to the number of stitches sewn.

As illustrated, the sensor vane 62 includes 120 evenly circumferentially spaced openings therein to achieve a resolution of 3° increments. A sensor 64 provides a reference or a sync signal against which the motor angle signals received from the sensor 66 are compared within the microprocessor controller 51 to fix the angular position in the sewing machine cycle, thus providing a reference for the microprocessor 51 to sense the motor angle and the revolutions of the motor. With the sensor 64 and 66, the microprocessor controller can determine each 3° incremental rotation of the motor shaft 58.

Any suitable interrupt type sensors can be utilized for the sensors 64 and 66. For example, a model TIL 147 photo-optical sensor from Texas Instruments, Inc. can be used for sensor 66. A model TL 172C Hall effect sensor from Texas Instruments, Inc. can be utilized for sensor 64.

Referring now to FIGS. 3 and 4, further details of edge sensors 40 and their cooperation with needles 22 and 23 can be seen. If desired, only one edge sensor 40 can be used with sewing machine 12; however, complex shaped parts may require two or even three edge sensors located in laterally spaced-apart relationship in front of the needle. Sensors 40 can be mounted directly on the housing of sewing machine 12, or supported by other suitable means. As illustrated, each sensor 40 comprises a lamp/photosensor which projects a spot of light 40*a* onto a reflective strip 68 on throat plate 36. The status of each sensor 40 is either on or off depending upon whether the light beam thereof is interrupted, such as by passage of material over reflective strip 68 in the direction of arrow 70 in FIG. 4. Sensors 40 thus function to sense the presence of material being sewn and to signal the approach of the seam end by sensing passage of the trailing edge of the particular piece of material.

It will be appreciated that a significant feature of the present invention comprises usage of at least one and possibly a plurality of sensors 40 positioned in mutually spaced relationship ahead of needles 22 and 23 of sewing machine 12. Sensors 40 indicate whether or not the end of a particular seam is being approached. The condition of at least one sensor 40 changes as the trailing material edge passes thereunder to indicate approach of the seam end point. Sensors such as the Model 10-0672-02 available from Clinton Industries of Carlstadt, N.J., have been found satisfactory as sensors 40; however, infrared sensors and emitters, or pneumatic parts in combination with back pressure sensors could also be utilized, if desired. When infrared sensors are used, internal material edges can be detected. Any type of on/off sensors capable of detecting the presence or absence of material a preset distance in front of needles 22 and 23 can be utilized with apparatus 10 since the exact mode of their operation is not critical to practice of the invention.

Figure 5:
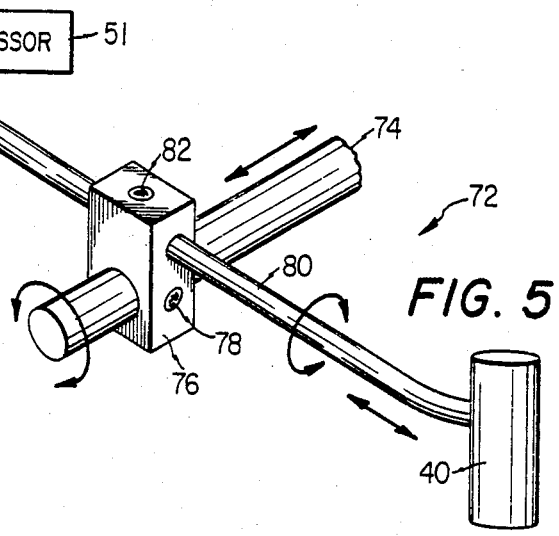
FIG. 5 illustrates the edge sensor mounting.

Sensors 40 can be mounted directly on the housing of sewing machine 12 or on a mounting assembly 72 as shown in FIG. 5. Assembly 72 includes a transverse support bar 74 to which is attached a mounting block 76 for each sensor 40. Mounting blocks 76, only one of which is shown, are slideable and rotatable relative to support bar 74, and can be secured in any desired position thereon by means of set screws 78. Each sensor 40 is attached to the end of a rod 80 slideably extending through its corresponding block 76 and secured in place by set screw 82.

Mounting assembly 72 thus facilitates adjustment of sensors 40 in the desired spaced relationship with respect to each other and with respect to sewing needles 22 and 23 in accordance with the shape of the material being sewn and other considerations of the particular sewing operation. Reflective tape 68, of course, could also be repositioned accordingly.

Figure 6:
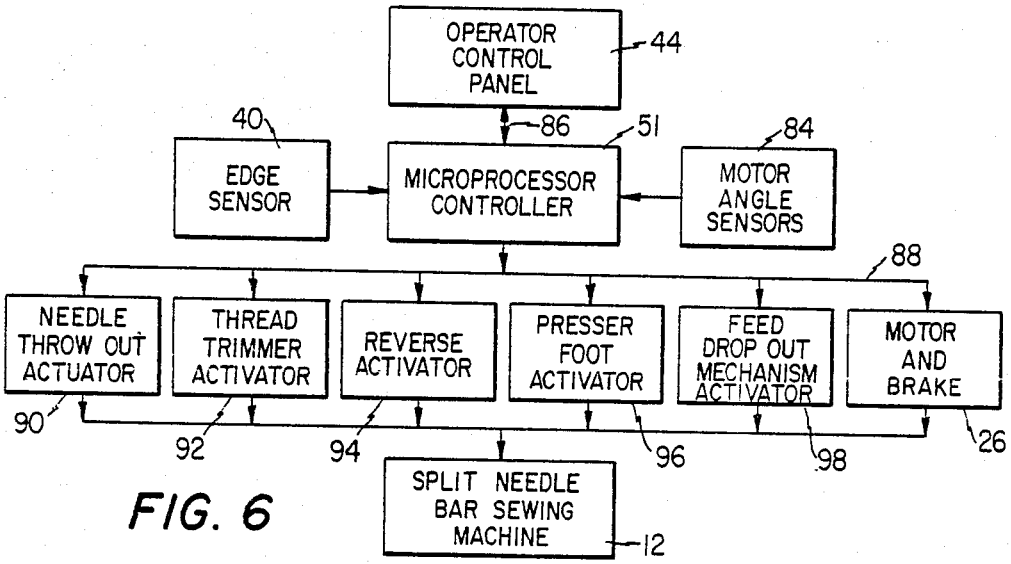
FIG. 6 illustrates a system block diagram for the present invention.

Referring now to FIG. 6, there is illustrated a schematic diagram of the system 10 controlled by the microprocessor controller 51. The microprocessor controller 51 receives signals from the edge sensors 40, the operator control panel 44 and from the motor angle sensors 64 and 66, as represented by a block 84. The microprocessor controller can also send signals to the operator control panel, as depicted by a two-headed arrow 86. The microprocessor controller also sends signals to the controls attached to the split needle bar sewing machine 12 as represented by a parallel data line or signal line 88. The signal line 88 connects the microprocessor controller 51 with the needle throw-out actuators 41 and 43, as represented by a block 90. A thread trimmer activator is also controlled by the microprocessor 51, as represented by a block 92. The reverse actuator 17, represented by a block 94, and the presser foot activator 30, as represented by a block 96, are also controlled by the microprocessor controller through the signal line 88. The feed drop out mechanism activator, represented by a block 98, is controlled by the microprocessor controller 51 to automatically cause the feed dog of the sewing machine 12 to stop feeding the materials. In this manner, the stitch can be shortened by keeping the material from feeding. Finally, the motor and brake 26 are also controlled by the microprocessor controller. All of these functions, 26, 90, 92, 94, 96 and 98 are controlled by the microprocessor controller 51 and operable to control the operations of the split needle bar sewing machine 12.

Figure 7:
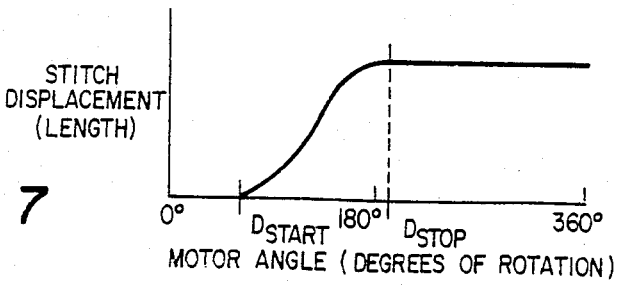
FIG. 7 illustrates a graph of stitch displacement versus motor angle in degrees.

FIG. 7 is a graph illustrating the length of a stitch displacement versus the rotation of the motor of the sewing machine. In an industrial sewing machine, the transport mechanism comprises a feed dog and presser foot. The amount by which the material being sewn is advanced for each stitch, termed "stitch length", can be controlled by mechanical adjustments on the sewing machine. FIG. 7 illustrates the interval over 360° rotation of the sewing machine motor during which the stitch formation occurs. The interval over which the stitch formation occurs varies depending upon the machine type, such as drop feed, needle feed, top feed and the like. FIG. 7 illustrates material advancement over approximately 120° of the motor rotation of a typical sewing machine such as shown in FIG. 1. As shown in FIG. 7, the stitch is not begun until the motor has rotated approximately 60°. The stitch is then formed until it is completed after the sewing machine motor has completed approximately 180° rotation. The last 180° rotation of the sewing machine motor enables the machine to ready for the formation of the next stitch. The interval of the motor rotation is dynamically detected by the controller 51 over which stitch formation occurs, in order to determine the percentage of the stitch completed at edge detection.

Figure 8:
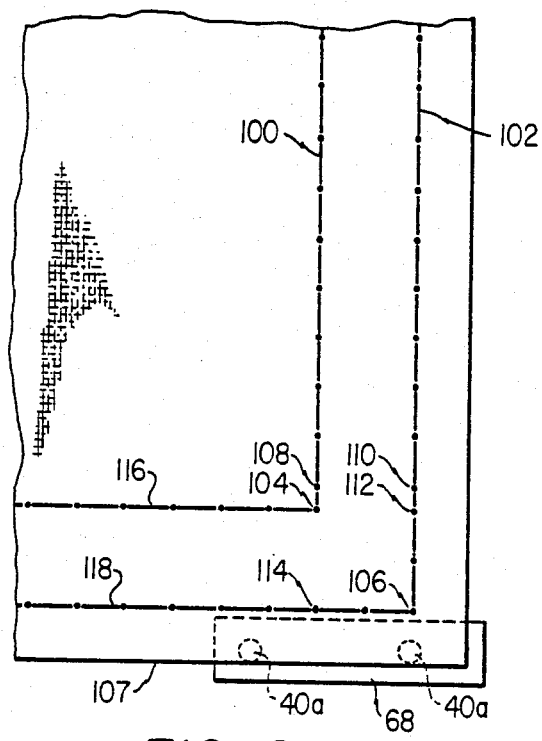
FIG. 8 illustrates a right mitered corner sewn on a piece of material utilizing the edge detecting sensor.

Referring now to FIG. 8, there is illustrated a top view of a 90° mitered corner sewn under control of the microprocessor controller 51. The mitered corner of FIG. 8 consists of an inside seam 100 and an outside seam 102. The corner has a pivot point 104 and an apex 106, the pivot point defined as the inside corner of the mitered corner and positioned from the edge of the material a distance equal to the sum of the distance between the two needles and the seam margin. The stitches along both seams 100 and 102 are synchronous, that is, parallel stitches are of equal length and the needles penetrate the material at the same point in time.

The double needle sewing operation continues along the seams 100 and 102 until the edge of the material, as represented by a reference number 107, uncovers one of the reflective spots **40*a* on the reflective strip 68. When this occurs, the controller 51 interprets the output from the sensors 40 to provide a reference point for the mitered corner. Once the controller 51 has determined a reference point for the mitered corner, it determines the number of stitches and/or partial stitches required to sew from the detected point to the pivot point 104. The controller allows the machine, after detection of the edge 107, to continue sewing standard length stitches up to the stitches 108 and 110 corresponding to the left needle 22 and the right needle 23, respectively. Since the pivot point 104 may not be disposed the distance of a standard stitch from the point 108, it may be necessary to sew a partial stitch between the stitch 108 and the pivot point 104. To accomplish this, the controller calculates the number of degrees of rotation for the motor that is required to sew an appropriate length stitch. Once calculated, the left needle 22 and the right needle 23 proceed from the points 108 and 110, respectively, to the pivot point 104 and a stitch point 112. Since, as described above, these points are indicative of the penetration point of the needle, the ensuing action of the double needle sewing procedure is to raise needles out of the material. When the left needle 22 is raised, the throw-out actuator 41 is activated to disable the left needle 22, and the right needle 23 is allowed to continue sewing in the single needle mode. The right needle 23 sews along the seam 102 from the stitch point 112 to the apex 106 sewing two stitches. At this point, the controller 51 stops the machine and automatically raises the presser foot 24** to allow the operator to realign the material at the proper angle, in this case 90°.

Upon resuming the sewing operation, the presser foot 24 is again lowered and single needle stitching continues for two stitches to the stitch point 114 which is the point at which the left needle 22 is lined up with the pivot point 104. At this point, the controller 51 again resumes double needle sewing with both needles 22 and 23 to sew seams 116 and 118.

The sewing operation from the stitch point 112 for single needle sewing to the apex 106 and then from the apex 106 to the stitch point 114 requires only two stitches for each segment. In order for this to occur such that the point 114 again lines up with the pivot point 104, it is necessary that the gauge, that is, the distance between the seams 100 and 102, be equal to twice the stitch length and the angle must be 90°. If the stitch length is changed without changing the needle gauge, it will then be necessary to sew either an extra partial stitch or shorten one of the stitches in the sewing operations around the apex 106.

Figure 9:
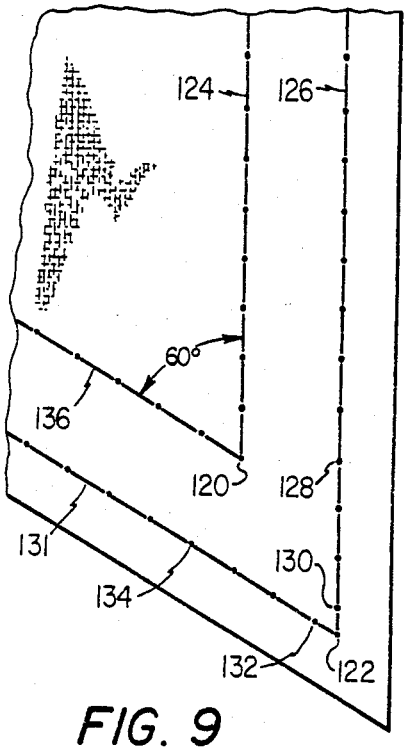
FIG. 9 illustrates a 60° mitered corner with shortened stitches at the apex thereof.

Referring now to FIG. 9, there is illustrated a pattern for a 60° mitered corner which utilizes an alternate method for determining the pivot point. The mitered corner of FIG. 9 has a pivot point 120 and an apex 122. The double needle sewing sequence proceeds along a seam 124, corresponding to the left needle 22, and a seam 126, corresponding to the right needle 23. Upon initiation of the sewing sequence (not shown), the controller 51 counts a predetermined number of stitches therefrom to the pivot point 120. This insures that equal length stitches will be sewn to the pivot point 120 by the left needle 23 along the seam 124 and by the right needle 23 along the seam 126 to a stitch point 128. At this point, the controller 51 activates the throw-out actuator 41 to disable the left needle 22 and continue single needle sewing along the seam 126 to the apex 122. Single needle sewing with equal length stitches is continued to a stitch point 130. The length of the stitch between the stitch point 130 and the apex 122 is illustrated as a short stitch which results from the controller 51 activating the feed drop out mechanism to thereby shorten the stitch. In this manner, the length of the seam 126 between the stitch point 128 and the apex 122 can be accurately controlled. Although there may be certain stitch densities which allow equal length stitches to be sewn between the stitch point 128 and the apex 122, varying the length of the terminating stitch along the segment allows the sewing operation to proceed for any given stitch density.

After sewing to the apex 122 along the seam 126, the controller 51 automatically stops sewing and then raises the presser foot 24 with the needle 23 in the down position to allow the operator to realign the material to sew the remaining side of the mitered corner. After realignment, the sewing operation is continued by the operator and the controller 51 automatically lowers the presser foot 24 and begins sewing with the right needle 23 to sew a seam 131. The initial stitch between the apex 122 and the stitch point 132 on the seam 131 is a short stitch that is equal to the stitch length between the stitch point 130 and the apex 122. Single needle sewing is then continued along the seam 131 at the original stitch length to a stitch point 134 which is the point where the left needle 22 is lined up with the pivot point 120. At this point, the controller 51 again activates the double needle sewing operation to continue sewing the seam 131 and sew a seam 136, corresponding to the needle 22.

The stitch length between the stitch point 130 and the apex 122 and the stitch length between the apex 122 and the stitch point 132, are equal such that the distance sewn between the stitch point 128 and the apex 122 and the equal distance sewn between the apex 122 and the stitch point 134 are adjusted such that single needle sewing around the apex 122 results in alignment of the left needle 22 at the pivot point 122 when the stitch point 134 is sewn. To accomplish this, the controller 51 must calculate the number of normal length stitches between points 128 and 130, the length of the stitch between the stitch point 130 and the apex 122, the stitch length between the apex 122 and the stitch point 132 and the number of normal length stitches between points 132 and 134 to accurately synchronize the needles. It should be understood that the shortened stitch is sewn on both sides of the apex 122 for aesthetic reasons. The shorter stitch can be sewn anywhere from either side of the apex 122 during single needle sewing.

Figure 10:
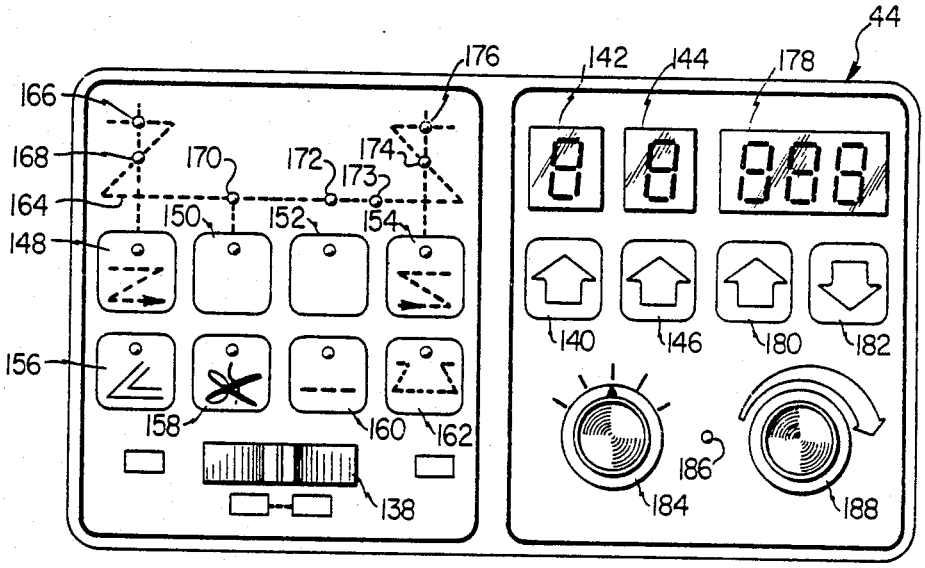
FIG. 10 illustrates a frontal view of the control panel.

Referring now to FIG. 10, there is illustrated a front view of the control panel 44. A mode select switch 138 is disposed on the front panel which is comprised of a three position switch having the positions LEARN, AUTOMATIC and MANUAL. The LEARN position allows data to be input to the panel 44 and to be routed to the controller 51, the AUTOMATIC position allows the controller 51 to semi-automatically control the operation of the machine 12 and the MANUAL position allows the operator to control the operation of the machine 12. A program increment switch 140 is a switch which is utilized to select the stored program that is desired. Programs are prestored in the LEARN mode and can be selected by depressing the switch 140 until the proper number is displayed on a program number display 142. Each program represents a two needle decorative stitching operation that has been prestored.

A seam number display 144 displays the particular seam of a given pattern that is being worked upon. For example, some patterns may have 10 or more seams with associated mitered corners therebetween. The display 144 is incremented by depressing a seam number increment switch 146 to display the particular seam that is to be utilized in the particular decorative stitching operation being programmed.

A PRETACK ENABLE switch 148 allows the operator to select the pretack operation. A STITCH COUNT ENABLE switch 150 allows the operator to select the mode wherein the length of the seam is to be controlled by stitch counting. Otherwise, the seam length will be controlled by use of the edge sensor 40 and sensor enable switch 152 which enables this mode. An ENDTACK ENABLE switch 154 provides the operator the option of putting an end tack at the end of the operation and an ANGLE ENABLE switch 156 can be depressed to allow the operator to input the desired angle at the end of a selected seam. A THREAD TRIM ENABLE switch 158 allows the operator to select the mode wherein the thread is automatically trimmed and a (SEAM ENABLE) switch 160 is depressed prior to selecting the seam number with the increment switch 146. A PROMPT INCREMENT and ENTER switch 162 allows the operator to select a mode wherein the prompts are inputted on the switches 148–160. The switches 148–162 have associated with them a light emitting diode (LED) to indicate to the operator the particular operation that is being selected.

A seam graphic 164 is disposed on the panel 44 to provide a visual display for the operator. A prompting LED 166 is disposed on the graphic 164 to illustrate forward stitches in PRETACK. An LED 168 is disposed on the graphic 164 to indicate prompting for reverse stitches in PRETACK. An LED 170 is disposed on the graphic 164 to indicate prompting for stitch count. An LED 172 is disposed on the graphic 164 to indicate prompting for distance count between detection of the material edge and initiation of the cornering sequence. An LED 173 is disposed on the graphic 164 to indicate prompting for the particular angle desired. An LED 174 is disposed on the graphic 164 to indicate prompting for reverse stitches in ENDTACK. An LED 176 is disposed on the graphic 164 to indicate prompting for forward stitches in ENDTACK. The LED's 166–176 provide the operator with an indication of the particular portion of the pattern that is being programmed.

Associated with the program number display 142 and the seam number display 144 is a three digit display 178 that displays the number of stitches to be sewn in the seam if the seam is stitch counted rather than under control of the edge sensor. In addition, with edge detection, the three digit data display is utilized to display the number of pulse counts to be sewn after detecting the edge. The three digit display is also used to display the number of degrees at each pivot point and the number of stitches sewn in the PRETACK and ENDTACK sequences. To increment the three digit data display 178, an increment switch 180 and a decrement switch 182 are utilized to increase or decrease, respectively, the number contained in the data display 178. Switches 178 and 180 and display 178 are used in cooperation to program the microprocessor for each sewing operation (program). As described above, the revolutions of the motor and the angle thereof are sensed through the pulses resulting from the sensors 64 and 66. By counting the number of pulses and relating this to the displacement of the stitch, as shown in FIG. 5, the length of the stitch can be sensed. For example, in an exemplary embodiment each stitch is divided into 47 distance count pulses which determine a complete stitch. If a shorter stitch is desired, it is only necessary to decrease the feed rate after a predetermined number of pulses has been sensed by activating the reverse mechanism 17 or to activate the feed drop out mechanism to terminate the stitch prematurely. In this manner, a shorter stitch can be sewn. With the edge sensor 40, it is only necessary to program in a number of distance count pulses corresponding to the number of whole and partial stitches to be sewn. For example, if an operator determines that only 50% of a stitch must be sewn after detecting the edge, the operator inputs approximately 24 distance count pulses (47 count pulses equaling a complete stitch) into the three digit display 180 to indicate the length of the stitch to be sewn.

A fabric select knob 184 allows the operator to select the type of fabric being sewn since the type of fabric determines the amount of infrared light transmitted through the fabric when infrared sensors are used to detect internal material edges. A sensor LED 186 indicates activation of the sensor 40 and a sensor sensitivity adjustment knob 188 allows for adjustments of the sensitivity of the sensors 40. The operator utilizes the control panel 44 to input a programming sequence for storage in random access memory (RAM) for later retrieval to semi-automatically control the machine 12. The operator initiates the program sequence by first setting the mode select switch 138 to LEARN and then depresses the program increment switch 140 until the desired program number is displayed in the display 142. In the preferred embodiment, 8 programs can be stored in memory for later retrieval. Choosing one of the 8 program numbers, a pattern can be stored therein. However, if a program number is selected that already has a stored program therein, entry of a new program will "write over" the old program thus erasing it.

After the program number has been selected, the seam number increment switch 146 is depressed until the number "1" is displayed in the seam number display 144. In the preferred embodiment, a maximum of twelve seams can be programmed in each of the eight decorative stitching operations (programs). The seams referred to with the seam number increment switch are seams between angles and initiating and end points, that is, the seams between two different mitered corners, the seams between an initiating point and one of the mitered corners or between one of the mitered corners and the end point. For example, in a typical square or rectangular pocket, there will be two right angled mitered corners, two side seams and a bottom seam.

In initiating the program, the first seam is normally begun with a PRETACK and is programmed by depressing the PRETACK ENABLE switch 148. If the length of the first seam or the seam being programmed is to be controlled by stitch counting, the STITCH COUNT ENABLE switch 150 is depressed. Otherwise, as described above, the seam length will be controlled by use of the edge sensor and the sensor enable switch 152 must be depressed to select this operation. After selecting the stitch counting mode or sensor mode, the number of stitches in the seam is selected if the seam is stitch counted and, for edge sensing, the number of distance count pulses desired after the edge sensor detects the edge is selected. As described above, selecting the number of stitches determines where double needle sewing is terminated and also determines the pivot point of the mitered corner. Using the stitch counting method, all stitches will have uniform density and length whereas the edge detection method provides a shortened stitch capability prior to terminating double needle sewing at the pivot point.

After the number of stitches has been entered into the display 178 with the switches 180 and 182, the angle enable switch 156 must be depressed and the angle at the pivot point must be input using the three digit display 178 and the increment and decrement switches 180 and 182. After the angle has been input, the seam number increment switch 146 is depressed to increment the seam number by one and the sequence for programming a seam and angle is utilized to program the second seam and subsequent seams.

On the last seam in the operation, the ANGLE switch 156 should not be enabled. Rather, the ENDTACK ENABLE switch 154 and/or THREAD TRIM ENABLE switch 158 can be enabled if an ENDTACK and/or a thread trim are desired. On the last seam it should be noted that as each step in the procedure is carried out, one of the LEDs 166–176 is activated to provide an indication to the operator which mode is being programmed.

In addition to programming the operation described above, the needle gauge of the sewing machine 12 and the stitch density must also be input to the microprocessor 51. These values are input and stored by means of a dual inline package (DIP) switch (not shown) that is located on the operator control panel 44. The DIP switch is a single throw single pole switch having eight switches contained therein for opening or closing a particular switch. The DIP switch is commercially available from GrayHill, Inc. Three of the switches on the DIP switch are allocated for the gauge data and five of the switches thereon are allocated for the stitch density data. To program the gauge data, the switches 1–3 for the gauge data are closed according to Table I wherein 0 represents an open end switch and C represents a closed switch.

TABLE I

| SWITCH 1 | SWITCH 2 | SWITCH 3 | GAUGE DIMENSION (Inches) |
|---|---|---|---|
| 0 | 0 | 0 | 1/16 |
| 0 | 0 | C | $\frac{1}{8}$ |
| 0 | C | 0 | 3/16 |
| 0 | C | C | $\frac{1}{4}$ |
| C | 0 | 0 | 5/16 |
| C | 0 | C | $\frac{3}{8}$ |
| C | C | 0 | 7/16 |
| C | C | C | $\frac{1}{2}$ |

The stitch density data is entered utilizing the remaining switches on the DIP switch. Since there are five switches set aside for this data, a binary data number from 0 to 31 can be entered therein. A binary number for 0 represents a stitch density of 4 stitches per inch with an increment of 0.5 stitches per inch for each numeral thereafter. For example, a 1 equals 4.5 stitches per inch, a 2 equals 5 stitches per inch and a 3 equals 5.5 stitches per inch, etc. The general formula for stitch density is equal to 4 plus the switch value multiplied by 0.5.

Figure 11:
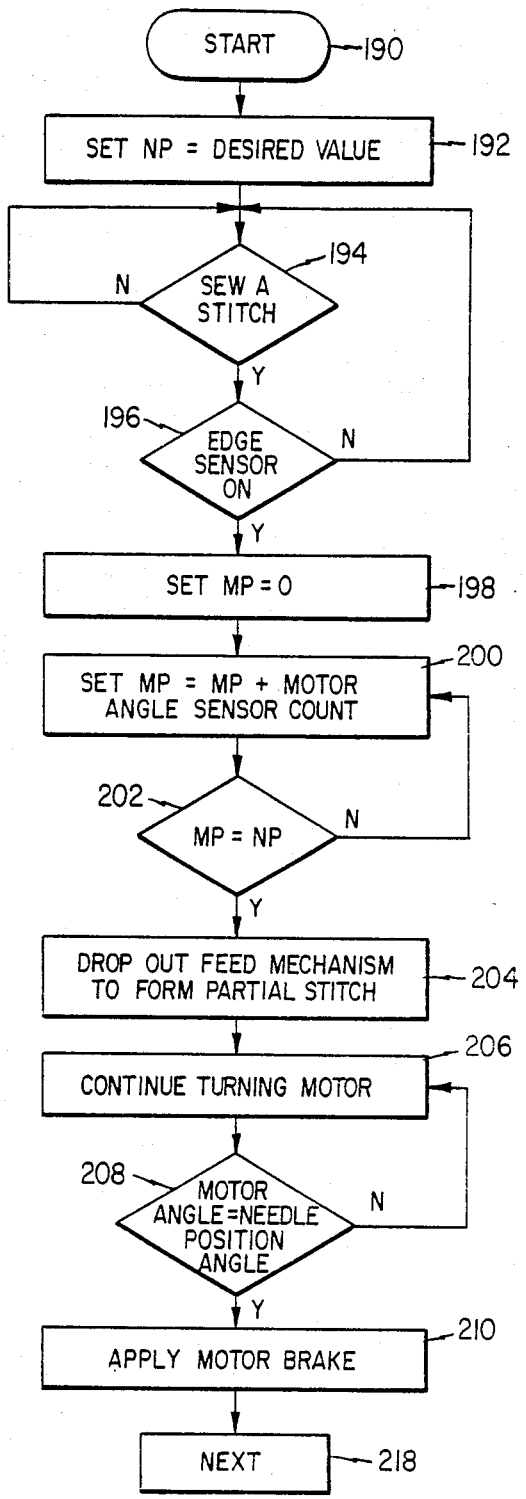
FIG. 11 illustrates a flow chart for determining the pivot point.
Figure 12:
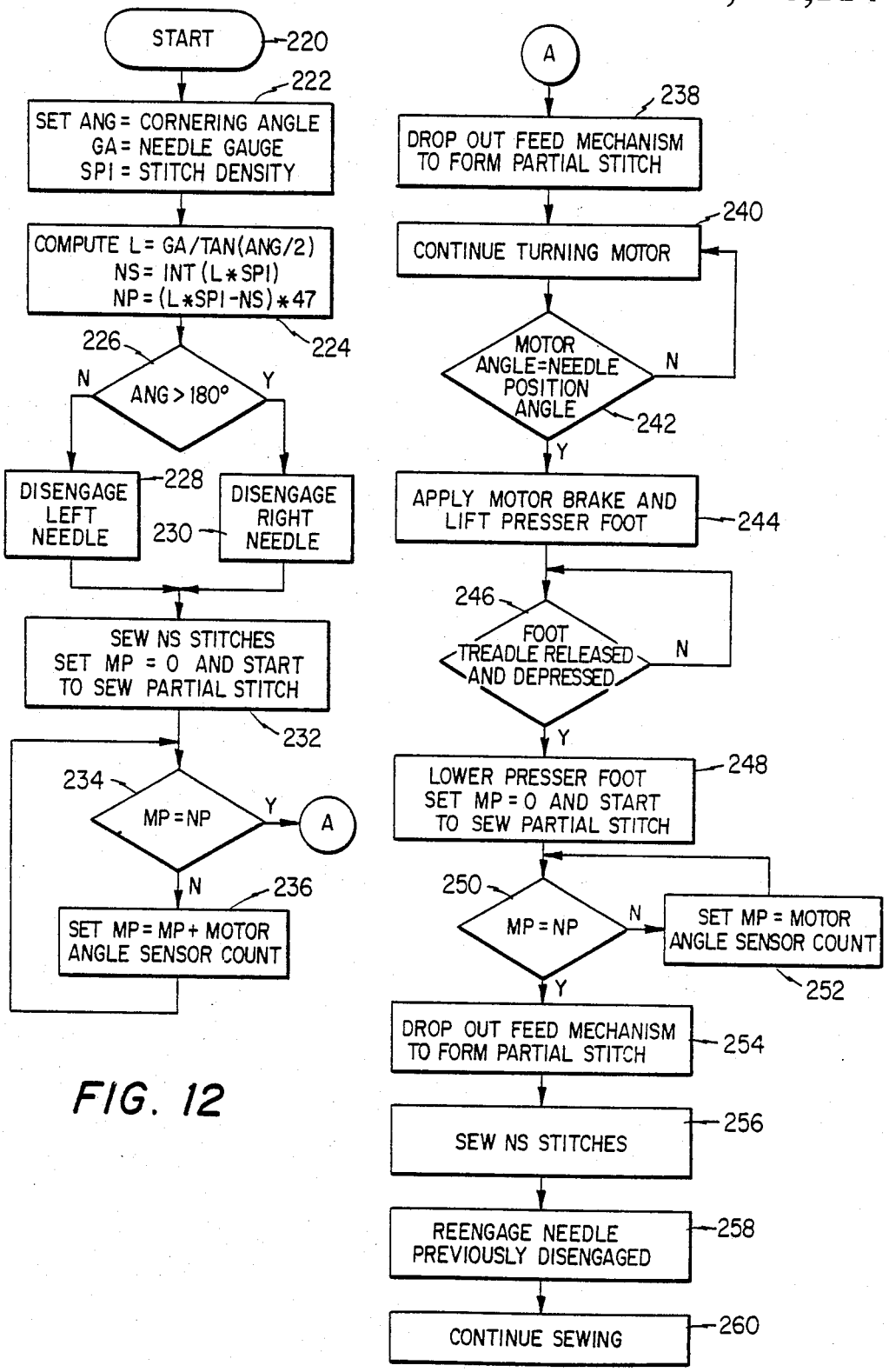
FIG. 12 illustrates a flow chart for sewing from the pivot point to the apex and from the apex to the pivot point to complete the mitered corner.

In order to perform the operation in the semi-automatic mode wherein the microprocessor automatically controls the cornering sequence for the desired mitered corner, the operator places the MODE SELECT switch 138 in the AUTO position. The operator then places the material under the needles 22 and 23 and depresses the foot treadle 28 on the machine to initiate the sewing operation. As the part is advanced by the feeding mechanism to sew the first seam, the edge sensor 40 which is in line with and directly ahead of the feeding side of the needles, is operable to detect the material edge. The microprocessor determines in a real time mode the number of normal and partial double needle stitches required to reach the pivot point. The flow chart for this operation is illustrated in FIG. 12 for the logic utilized to determine the pivot point. The microprocessor enters the program at a start block 190 and proceeds to a function block 192 wherein the number of motor pulses are input, as described above with reference to FIG. 11, that are to be sewn after edge detection. This is referred to as NP. The program then proceeds to a decision block 194 to determine if a stitch has been sewn. If a stitch has been sewn, the program proceeds along the "Y" path thereof and, if not, the program proceeds along the "N" path thereof back to the input of the decision block 194. Along the "Y" path, the program proceeds to a decision block 196 to determine if the edge sensor is on, thus indicating that the material edge has been reached. If the material edge has not been reached, the program proceeds along the "N" path to the input of the decision block 194 and if the edge has been reached, the program proceeds along the "Y" path of the decision block 196 to a function block 198 to set the number of sensed motor pulses (MP) equal to 0. The program then proceeds to a function block 200 wherein MP is incremented by the pulses sensed from the motor under continued sewing. The program then proceeds to a decision block 202 to decide whether the pulses accrued in the counter MP are equal to the stored number of pulses to be sewn as NP. If they are not equal, the program proceeds along the "N" path back to the function block 200 to continue accruing pulses in the counter MP and, if the MP is equal to NP, the program proceeds along the "Y" path of the decision block 202.

The "Y" path of the decision block 202 proceeds to a function block 204 wherein the drop out feed mechanism is activated to form a partial stitch by discontinuing material feed for the remainder of the stitch cycle. The program then proceeds to a function block 206 to continue turning the motor. The program proceeds to a decision block 208 to decide whether the motor angle is equal to the needle position angle required in order to brake the motor to position the needle in the down position. When the motor angle is at a sufficient point to allow braking of the motor, the program flows along the "Y" path to a function block 210 where the motor brake is applied. At block 210, the inside needle is then disengaged to terminate double needle sewing. The program then flows to a NEXT block 218 which allows the microprocessor to perform the next function which is to sew the cornering sequence around the apex of the mitered corner.

Since the edge of the material is normally not a point within the length of the partial stitch sewn and the terminating stitch prior to the pivot point, it is necessary in certain instances to detect the edge of the material at a distance equal to more than one stitch. For example, if it were determined that the edge of the material would be detected at a distance equal to approximately 6.59 times a stitch length, it would be necessary to program in the total number of pulses required for the motor to turn before the pivot point is reached. If 47 pulses of the motor angle sensor are set equal to one normal stitch, for 6.59 stitches a total number of 310 pulses are required which means that 6 normal stitches must be sewn and the partial stitch equal to 0.595 times the 47 pulses per stitch or 28 pulses is required for the partial stitch. Since the edge sensor can detect the edge at any point during the stitch, the normal and partial stitches can be distributed in any manner. Distribution corresponds to the formula $(1-X)+Y+Z$ where X is the part of the stitch taken when the edge sensor detects the edge, Y is the number of normal stitches and Z is the partial stitch added at the end to satisfy the stitch pulse count. The values of X and Z are in the range of 0 to 1.00 and Y is an integer. For example, the 6.59 stitches required with a pulse count of 310 could be distributed in any of the following manners:

| X | (1 − X) | Y | Z | TOTAL |
|---|---|---|---|---|
| 0.20 | 0.80 | 5 | 0.79 | 6.59 |
| 0.50 | 0.50 | 6 | 0.09 | 6.59 |
| 0.80 | 0.20 | 6 | 0.39 | 6.59 |

Referring now to FIG. 12, there is illustrated a flow chart for the cornering sequence after the pivot point has been reached. The program is entered at a starting block 220 and proceeds to a function block 222 wherein the cornering ANGLE, the needle gauge GA and the stitch density SPI are set. The program then flows to a function block 224 wherein the length of the segment from the pivot point to the apex L, the number of whole stitches to be sewn NS and the number of pulses in the partial stitch to be sewn NP are calculated. The length L is equal to the needle gauge GA divided by the tangent of $\frac{1}{2}$ of a cornering angle ANG/2. The number of stitches to be sewn NS is equal to the length L multiplied by the stitch density SPI, which product is rounded off to the smallest integer. The number of pulses for the partial stitch NP is equal to the fraction in excess of the number of whole stitches NS multiplied by the number of pulses per whole stitch, which is equal to 47 pulses per stitch in the preferred embodiment.

After L, NS and NP are calculated, the program proceeds to a decision block 226 to decide if the cornering angle is greater than 180°. If the cornering angle is less than 180°, the program proceeds along the "N" path to a function block 228 to disengage the left needle and if the angle is greater than 180°, the program proceeds along the "Y" path to a function block 230 to disengage the right needle. Since the decorative stitching pattern can proceed in either direction, the decision block 226 and the function blocks 228 and 230 provide the capability for the machine to disengage either the left or right needle and proceed therefrom.

After disengaging the proper needle, the program proceeds to a function block 232 to sew the number of whole stitches and set the number of pulses in the motor pulse counter MP to 0 wherein the partial stitch sewing operation is begun. The program then proceeds to a decision block 234 to decide if the number of pulses in the motor pulse counter MP is equal to the number of pulses NP required for the partial stitch. If there are insufficient pulses, that is, the stitch has not been fully sewn, the program proceeds to a function block 236 to increment the motor pulse counter MP by the motor angle sensor count and then return to the input of the decision block 234. When the motor pulse count MP is equal to the number of pulses required for the partial stitch NP, the program proceeds along the "Y" path to a function block 238 wherein the drop out feed mechanism is activated to form the partial stitch.

After forming the partial stitch, the program proceeds to a function block 240 to continue rotating the motor and then proceeds to a decision block 242 to decide if the motor angle is equal to the needle positioning angle to position the needle down. Until the proper angle is achieved, the program proceeds around the "N" path thereof to the function block 240 to continue turning the motor until the correct needle positioning angle is achieved wherein the program flows along the "Y" path to a function block 244 and the motor brake is applied and the presser foot is lifted. This allows the operator to manually realign the material to sew the remaining side of the corner.

After applying the brake and lifting the presser foot, the program proceeds to a decision block 246 to await release of the foot treadle in the braking position and depression of the foot treadle for the forward sewing operation. Until the foot treadle is released, the program flows in a loop around the "N" path thereof and, upon release, the program flows along the "Y" path to a function block 248 to set the motor pulse counter MP equal to 0 and begin sewing the partial stitch. The program flows to a decision block 250 to determine if the number of pulses accrued in the motor pulse counter MP is equal to the number of pulses required for the partial stitch. The program flows along the "N" path of the decision block 250 to a function block 252 to increment the motor pulse counter MP and then returns to the input of the decision block 250 until the pulses accrued in the motor pulse counter MP are equal to the number of pulses required for the partial stitch NP. At this point, the program flows from the decision block 250 along the "Y" path thereof to a function block 254 to activate the drop out feed mechanism to form the partial stitch. After forming the partial stitch, the program flows to a function block 256 to sew the required number of whole stitches NS to the pivot point. After sewing to the pivot point, the program proceeds to a function block 258 to re-engage the previously disengaged needle. The program then proceeds to a function block 260 to continue sewing.

When double needle sewing is resumed, the seam is stitched according to the preprogrammed number of stitches for that seam or for the detection of an edge. However, if the seam is the last seam the operation is terminated with an ENDTACK and/or thread trim operation. To accomplish this, auxiliary control means are utilized therefore.

In summary, there has been provided a semiautomatic split needle bar sewing machine that sews mitered corners with a minimum of operator intervention. The sewing machine has the capability of automatically detecting the pivot point for the mitered corner and disengaging the inside needle for single needle sewing around the corner. The microprocessor calculates the length of the single needle seam from the pivot point to the apex of the mitered corner and varies the number and length of the stitches therebetween such that the mitered corner is sewn correctly. At the apex, the microprocessor controller brakes the motor with the needle in the down position and automatically lifts the presser foot to allow the operator to manually realign the material. Upon resuming the sewing operation, the calculated number of stitches and/or partial stitches are sewn from the apex to the pivot point whereupon double needle sewing is again resumed. The parameters for a particular mitered corner are input on a control panel such that each mitered corner can be programmed for a given angle, a given needle gauge and a given stitch density.

Although the preferred embodiment has been described in detail, it should be understood that the various changes, substitutions and alterations can be made therein without departing from the spirit and scope of the invention as defined by the appended claims.

What is claimed is:

1. A semi-automatic split needle bar sewing machine having multiple needles for sewing mitered corners on sewn products, comprising:

means for storing the parameters of a mitered corner such that the length of the outside seam between the inside corner and the apex of the mitered corner is predetermined;

means for calculating the number and the length of the stitches to be sewn in the outside seam of the mitered corner from the inside corner to the apex and from the apex to the inside corner such that the number of stitches on the outside seam on both sides of the mitered corner is equal;

means for determining the position of the inside corner of the mitered corner on the material relative to the material edge;

means for disabling one needle of the split bar needle on the inside seam of the mitered corner at the inside corner;

means for varying the length of the stitch being sewn; and means for controlling and disabling means and said stitch varying means to automatically terminate double needle sewing at the inside corner and continue with single needle sewing of variable length stitches on the outside seam around the apex in accordance with the calculated values from said calculating means such that single needle sewing is terminated and double needle sewing begun after completion of the mitered corner.

2. The sewing machine of claim 1 wherein said determining means comprises at least one on/off sensor mounted ahead of the needles on the side from which the material is fed.

3. The sewing machine of claim 1 further comprising a material feed dog wherein said varying means comprises:

means for sensing the motor angle relative to the stitch displacement; and means for controlling the material feed dog to control the amount of material fed under the stitching needle.

4. The sewing machine of claim 3 further comprising:

means for counting the number of stitches being sewn;

means for storing a predetermined number of stitches to be sewn for a given seam; and said controlling means automatically terminating double needle sewing after said predetermined number of stitches is sewn thereby defining the position of the inside corner.

5. The sewing machine of claim 4 further comprising:

means for raising the presser foot on the sewing machine;

said controlling means automatically controlling said presser foot means to automatically terminate the sewing operation and raise the presser foot after a predetermined number of stitches are sewn between the pivot point and the apex of the mitered corner such that an operator can realign the material to complete the mitered corner.

6. A semi-automatic split needle bar sewing machine having multiple needles, a presser foot and a motor for sewing mitered corners in decorative and functional stitching on sewn products, comprising:

means for disengaging one of the needles of the split bar needle to discontinue double needle sewing on the inside seam at the inside corner of the mitered corner and allow only single needle sewing on the outside seam;

means for varying the length of stitches being sewn;

means for counting the number of stitches being sewn;

means for raising and lowering the pressure foot;

means for braking the motor and positioning the needle;

means for storing a profile for a plurality of mitered corners to define the relative position of the inside corner and the apex point of each mitered corner;

calculating means for calculating the length and number of stitches to be sewn in the outside seam of he mitered corner between the disengagement point at the inside corner and the apex of the mitered corner;

means for controlling the operation of the sewing machine to sew a mitered corner according to a selected one of said profiles by discontinuing double needle sewing at the inside corner of the mitered corner through control of said needle disengaging means and single needle sewing a number of stitches on the outside seam defined by said calculation means between the disengagement point and the apex on one side of the mitered corner and a number of stitches equal to the calculated number on said one side between the apex and the inside corner on the other side of the mitered corner with the stitch length varied to achieve the correct mitered corner in accordance with said calculation means;

said controlling means automatically braking the motor and positioning one of the needles down with the presser foot elevated at the apex of the corner; and said controlling means automatically re-engaging the remaining needle at the inside corner on the other side of the mitered corner.

7. The apparatus of claim 6 wherein said means for controlling the length of stitches comprises:

means for sensing the angle of the motor in the sewing machine to determine the position of the motor with respect to the needle position and the feed dog position;

means for altering the amount of material fed by the feed dog; and said controlling means controlling the operation of said altering means in response to said angle sensing means such that the amount of material being fed during the stitch can be altered to vary the length of the stitch.

8. The apparatus of claim 7 wherein said means for counting comprises a counter under the control of said means for controlling that senses said angle sensing means to determine the number of revolutions of the motor of the sewing machine.

9. The apparatus of claim 6 further comprising means for sensing a discontinuity in the material on the side from which the material is fed, said means for sensing mounted on the sewing machine such that said controller can determine the position of the inside corner with respect to said discontinuity according to said stored profile.

10. The apparatus of claim 9 wherein said sensing means comprises an on/off sensor.

11. The apparatus of claim 9 wherein said controlling means detects said discontinuity and varies the last double needle stitch before the inside corner.

12. The apparatus of claim 6 further comprising means for inputting said predetermined profile into said storage means.

13. The apparatus of claim 12 wherein said means for inputting is operable to modify said predetermined profile.

14. A method for sewing mitered corners on a split needle bar sewing machine, comprising:

automatically terminating double needle sewing by disengaging the inside needle at the inside corner of the mitered corner and allowing only single needle sewing on the outside seam;

calculating the length and number of stitches to be sewn on the outside seam between the disengagement point at the inside corner and the apex;

sewing the calculated number of stitches on the ouside seam to the apex of the mitered corner;

varying the length of the stitches in accordance with the calculated stitch length;

automatically terminating single needle sewing at the apex and allowing realignment of the material to sew the remaining side of the mitered corner;

sewing the calculated number of stitches upon resumption of single needle sewing to sew an identical number of stitches on the outside seam on the opposite side of the mitered corner from the apex to the point corresponding to the inside corner;

varying the length of the stitches in accordance with the calculated stitch length; and automatically resuming double needle sewing by reengaging the inside needle when the calculated number of stitches on the outside seam has been sewn.

15. The method of claim 14 further comprising storing a profile that defines the relative position of the inside corner and the apex of the mitered corner in order to calculate the number of stitches to be sewn from the disengagement point to the apex and from the apex to the reengagement point during single needle sewing, the profile having the length of the stitches and the gauge between the needles stored therein.

16. The method of claim 14 wherein the steps of sewing the calculated number of stitches comprises counting the number of stitches between the inside corner and the apex by sensing the revolutions of the motor.

17. The method of claim 17 further comprising modifying the predetermined profile to input the desired parameters for the mitered corner.

18. The method of claim 14 wherein the step of automatically terminating double needle sewing at the inside corner comprises:

detecting a discontinuity in the material from the feeding side of the presser foot to provide a reference point for determining the position of the inside corner relative to the material according to the profile;

counting a predetermined number of stitches from the point at which the discontinuity was detected; and varying the length of the last stitch sewn prior to the inside corner.

19. The method of claim 14 wherein the step of automatically terminating double needle sewing comprises counting a predetermined number of stitches that defines the inside corner and terminating double needle sewing at the end of the last stitch.

20. A method for sewing mitered corners on a split needle bar sewing machine for decorative and functional stitching of apparel products, comprising:

storing a profile containing the parameters of a desired mitered corner to be sewn with respect to the dimensions of the outside seam relative to the inside seam;

determining the relative position of the inside corner of the mitered corner with respect to the material edge;

automatically terminating double needle sewing at the inside corner by disengaging the inside needle and allowing only single needle sewing on the outside seam thereafter;

calculating the number of stitches and the length thereof for the outside seam between the disengagement point at the inside corner and the apex;

counting the number of stitches being sewn between the inside corner and the apex of the mitered corner on one side thereof;

varying the length of at least one of the stitches being sewn such that the overall length of the stitches is equal to the calculated value;

terminating single needle sewing at the apex and raising and lowering the presser foot to allow manual realignment of the material when the presser foot is raised;

counting the number of stitches sewn between the apex of the mitered corner and the inside corner on the other side of the mitered corner during single needle sewing from the apex to the inside corner;

varying the length of at least one of the stitches being sewn on the outside seam between the apex and the point at which the inside needle is proximate the inside corner on the other side of the mitered corner such that the outside needle is in the down position when the inside needle is proximate the inside corner wherein the correct mitered corner is achieved; and automatically resuming double needle sewing at the inside corner by reengaging the inside needle.

21. A method for sewing mitered corners on a split needle bar sewing machine for decorative and functional stitching of sewn products, comprising:

individually inputting the parameters of the mitered corner on a keyboard for a desired mitered corner having a specified angle, needle gauge and stitch density between the seams;

determining the relative position of the inside corner of the mitered corner with respect to the material edge;

automatically terminating double needle sewing at the inside corner and allowing only single needle sewing thereafter;

counting the number of stitches being sewn between the inside corner and the apex of the mitered corner on one side thereof;

varying the length of at least one of the stitches being sewn such that that correct mitered corner is achieved;

terminating single needle sewing at the apex and raising and lowering the presser foot to allow manual realignment of the material;

counting the number of stitches sewn between the apex of the mitered corner and the inside corner on the other side of the mitered corner during single needle sewing from the apex to the inside corner;

varying the length of at least one of the stitches being sewn between the apex and the inside corner of the mitered corner on the other side thereof such that the correct mitered corner is achieved; and automatically resuming double needle sewing at the inside corner.

22. The method of claim 20 wherein the step of determining the position of the inside corner comprises counting the number of stitches between initiation of the sewing operation and the inside corner as defined by the parameters stored in the profile.

23. The method of claim 20 wherein the step of determining the position of the inside corner comprises:

detecting the presence of a discontinuity in the material from the feeding side of the presser foot to provide a reference point for the needle with respect to the discontinuity; and counting a predetermined number of stitches between the point of detection of the discontinuity and the inside corner, the terminating stitch having the length thereof varied.

24. The method of claim 23 wherein the discontinuity is the edge of the material.

25. The method of claim 20 wherein the step of automatically terminating double needle sewing comprises disabling the inside needle.

26. The method of claim 20 wherein the step of varying the length of the stitches between the inside corner and the apex during single needle sewing comprises varying the length of only the terminating stitch at the apex.

27. The method of claim 20 wherein the step of varying the length of the stitches being sewn during single needle sewing between the apex and the inside corner of the mitered corner comprises varying the length of the first stitch sewn from the apex and counting a predetermined number of equal length stitches such that the correct mitered corner is achieved.

28. The method of claim 20 wherein the step of counting stitches comprises sensing the angle of the motor to determine the occurrence of each revolution thereof.

29. The method of claim 20 further comprising initiating the sewing operation by pretacking.

30. A method for sewing mitered corners on a split needle bar sewing machine for decorative and functional stitching on sewn products, comprising:

inputting and storing parameters defining a profile for a desired mitered corner having an inside corner along the inner seam thereof and an apex on the outer seam thereof, the gauge of the needles, and the stitch density;

detecting the presence of a discontinuity on the material from the feeding side of the presser foot of the sewing machine to provide a reference point between the needle and the material;

determining the position of the inside corner with respect to the detected discontinuity according to the predetermined profile;

counting a predetermined number of stitches to the inside corner determined from a reference point stored in the predetermined profile, the last stitch of which is varied;

terminating double needle sewing at the inside corner by disabling the inner needle;

calculating the number of whole stitches having a length determined by the stored stitch density required to sew the seam from the disengagement point to the apex and the length of the last stitch such that the needle is in the down position at the apex;

counting the calculated number of whole stitches between the disengagement point and the apex of the mitered corner during single needle sewing on one side of the mitered corner and varying the length of the last stitch in accordance with the calculated length such that the correct mitered corner is achieved;

terminating single needle sewing at the apex of the mitered corner and raising and lowering the presser foot to allow manual realignment of the material for resuming single needle sewing;

counting a predetermined number of stitches between the apex and the point at which the inside needle is proximate the inside corner during single needle sewing on the other side of the mitered corner, the first stitch of which has the length thereof varied to equal the length of the last stitch on the first side and the remaining stitches sewn at full length such that and correct mitered corner is achieved; and resuming double needle sewing by enabling the inside needle at the pivot point to end the pattern of the mitered corner.

* * * * *

UNITED STATES PATENT AND TRADEMARK OFFICE

CERTIFICATE OF CORRECTION

PATENT NO. : 4,526,114

DATED : July 2, 1985

INVENTOR(S) : Charles R. Martell; Elmer N. Leslie and Stephen S. Treadwell

It is certified that error appears in the above-identified patent and that said Letters Patent is hereby corrected as shown below:

Col. 17, line 53 (Claim 6, line 20) "seam of he" should be --seam of the--.

Col. 18, line 57 (Claim 14, line 10) "ouside" should be --outside--.

Col. 19, line 20 (Claim 19, line 1) "The method of Claim 17" should be --The method of Claim 15--.

Col. 22, line 29 (Claim 30, line 46) "that and correct" should be --that the correct--.

Signed and Sealed this

*Twenty-first* Day of *January 1986*

[SEAL]

*Attest:*

*Attesting Officer*

DONALD J. QUIGG

*Commissioner of Patents and Trademarks*